US007040483B2

(12) United States Patent
Inuzuka et al.

(10) Patent No.: US 7,040,483 B2
(45) Date of Patent: May 9, 2006

(54) PACKAGING BAG WITH WEAK SEALED DUCT

(75) Inventors: Takeshi Inuzuka, Chiyoda-ku (JP); Susumu Niwa, Chiyoda-ku (JP); Takayuki Kotani, Chiyoda-ku (JP)

(73) Assignee: Hosokawa Yoko Co., Ltd., (JP)

( * ) Notice: Subject to any disclaimer, the term of this patent is extended or adjusted under 35 U.S.C. 154(b) by 206 days.

(21) Appl. No.: 10/207,045

(22) Filed: Jul. 30, 2002

(65) Prior Publication Data

US 2003/0102229 A1 Jun. 5, 2003

(30) Foreign Application Priority Data

Aug. 6, 2001 (JP) ..... P2001-238361

(51) Int. Cl.
*B65D 25/08* (2006.01)

(52) U.S. Cl. ..... 206/219; 383/904; 383/906

(58) Field of Classification Search ..... 206/219, 206/524.3, 221; 604/410, 416; 383/210–211, 383/904, 906

See application file for complete search history.

(56) References Cited

U.S. PATENT DOCUMENTS 2,698,619 A * 1/1955 Beacham et al. ..... 604/415
3,066,848 A * 12/1962 Billeb ..... 383/210
3,074,544 A 1/1963 Bollmeier et al. ..... 206/47
3,520,471 A * 7/1970 Faust ..... 604/410
3,608,709 A * 9/1971 Pike ..... 206/219
4,402,402 A * 9/1983 Pike ..... 206/219
4,630,727 A * 12/1986 Feriani et al. ..... 206/221
4,890,744 A * 1/1990 Lane et al. ..... 383/906
5,211,643 A * 5/1993 Reinhardt et al. ..... 604/416
5,837,336 A * 11/1998 Ichimura et al. ..... 383/211
5,865,309 A * 2/1999 Futagawa et al. ..... 206/219
5,998,782 A 12/1999 Koyama et al. ..... 206/219
6,186,998 B1 * 2/2001 Inuzuka et al. ..... 604/410
6,645,191 B1 * 11/2003 Knerr et al. ..... 604/410

FOREIGN PATENT DOCUMENTS

DE 28 21 435 11/1979
EP 0 920 849 A2 6/1999
GB 2 134 067 A 8/1984
JP 09-327498 * 12/1997

* cited by examiner

*Primary Examiner*—Bryon P. Gehman
(74) *Attorney, Agent, or Firm*—Steptoe & Johnson LLP

(57) ABSTRACT

A packaging material capable of having a desired sealing strength with ease and a packaging bag using such material are provided. A packaging material, which serves as either one of a first and a second packaging materials to be heat-sealed to each other, includes a sealing portion. This sealing portion is relatively weaker in sealing strength and composed of an applied area of a coating agent preventing the heat sealing and a non-applied area of the coating agent. The applied area and the non-applied area are changed in an area size from each other depending on the sealing strength required for the sealing portion.

4 Claims, 4 Drawing Sheets

PACKAGING BAG WITH WEAK SEALED DUCT

BACKGROUND OF THE INVENTION

1. Technical Field

The present invention relates to a packaging material formed to have different sealing strengths region by region and heat-sealed to a second packaging material and to a packaging bag manufactured by using such packaging material.

2. Related Art

Conventionally, a variety of kinds of packaging bags have been used for packaging various substances. As one of such packaging bags, there has been provided a packaging bag preferred to contain different kinds of substances, such as liquids.

Such a packaging bag is formed as a single bag member, but has a plurality of partitions in which different kinds of substances are contained, respectively, and whenever necessary, the substances are made to be mixed with each other within the same bag. Practically, the packaging bag includes a sealed portion, whose sealing strength is weaker, that resides at a dividing portion between the partitions. When necessary, the bag is pressed to separate the sealed portion between two packaging materials, thereby the contained substances communicating with each other to be mixed.

Conventionally, to produce relatively weaker and stronger sealing portions, a particular resin film has been adopted and temperature and pressing pressure necessary for a heat-sealing process have involved adjustment operations.

However, the use of such special resin film results in a higher manufacturing cost. Moreover, adjusting the temperature and pressing pressure for the heat-sealing process requires difficult and troublesome adjustment work. What is worse, it is not always true that a desired sealing strength is obtained, even if such factors as temperature and pressing pressure are adjusted precisely. Thus, the sealing strength varies widely, thus resulting in unstable sealed quality.

SUMMARY OF THE INVENTION

The present invention has been made with due consideration to the foregoing drawbacks, and an object of the present invention is to provide a packaging material and a packing bag, which are able to have desired different sealing strengths with ease at a lower manufacturing cost.

In order to attain the above object, the present invention provides, as one aspect, a packaging material serving as either one of a first and a second packaging materials to be heat-sealed to each other, including a sealing portion relatively weaker in sealing strength. The sealing portion is composed of an applied area of a coating agent preventing the heat sealing and a non-applied area of the coating agent. The applied area and the non-applied area are changed in an area size from each other depending on the sealing strength required for the sealing portion.

According to the present invention, a weaker sealing portion (i.e., the sealing portion) of which sealing strength is relatively weaker can be formed on a packaging material very easily. Thus, when such packaging material is used to manufacture packaging bags or others with a sealed portion having a predetermined weaker sealing strength, it is just enough to select, from a variety of packaging materials, a packaging material having a weaker sealing portion to which the coating agent is applied correspondingly to the predetermined weaker sealing strength. Selecting such a packaging material will lead to an extremely easier manufacture of the products. In addition, unlike the conventional, a special resin is unnecessary for making the bag, thus a manufacturing cost being suppressed as well.

Preferably, the second sealing portion is formed only on either one of the first and second packaging materials and is separable between the first and second packaging materials.

According to this configuration, two packaging materials are laminated and heat-sealed to each other. It is easier to form, between the heat-sealed materials, two kinds of sealed portions, one of which is relatively weaker in sealing strength than the other. An area-size ratio between the applied area and the non-applied area in the sealing portion of which sealing strength is controlled, so that a desired sealing strength can be given to the weaker sealed portion in an easier manner.

It is also preferred that the coating agent is heat resistant resin. Hence the heat resistant resin which has been applied to the material is able to responsively prevent the materials from being bonded (sealed) to each other.

Of a variety of kinds of resin, shellac, which is natural resin, is best suitable. The shellac is an animal natural resin that does not contain harmful organic matters at all. Thus, when medical packaging bags are manufactured using the present packaging material, such bags will have no harmful influence on the human body.

Further, in the present invention, the material may be formed into a layered structure including a layer made of an aluminum foil, resulting in that the material is able to have both of high light blocking effect and high barrier effect toward shocks, injuries, or others.

In order to achieve the foregoing object, as another aspect of the present invention, there is provided a packaging bag comprising a first packaging material and a second packaging material. This second packaging material is heat-sealed to the first packaging material to form a first sealed portion and a second sealed portion weaker in sealing strength than the first sealed portion. The second sealed portion is (i): separable between the first and second packaging materials, and (ii): heat-sealed using a sealing portion formed on only the second packaging material and composed of an applied area of a coating agent preventing the heat sealing and a non-applied area of the coating agent. The applied area and the non-applied area are changed in an area size from each other depending on the sealing strength required for the first and second sealed portions.

According to the present invention, the two packaging materials can be laminated and heat-sealed to each other to manufacture a packaging bag. In such a manufacturing process, two type of sealed portions, one of which is relatively weaker in sealing strength than the other, is formed easily.

In the packaging bags according to the present invention, the coating agent is heat resistant resin. Particularly, it is preferred that the coating agent is shellac. It is also preferred that the material is formed into a layered structure including a layer made of a aluminum foil.

Still preferably, the above packaging bag may be configured such that the second packaging material is heat-sealed to the first packaging material to form a plurality of containing spaces by surrounding the containing spaces with the first sealed portion. The plurality of containing spaces are respectively charged with a plurality of substances to be mixed with each other. The second sealed portion connects the plurality of containing spaced to each other.

It is further preferred that a duct is inserted into the bag so that the duct reaches one of the plurality of containing spaces via a portion formed of the second sealed portion.

BRIEF DESCRIPTION OF THE DRAWINGS

Other objects and aspects of the present invention will become apparent from the following description and embodiments with reference to the accompanying drawings in which.

DETAILED DESCRIPTION OF PREFERRED EMBODIMENTS

Referring to the accompanying drawings, preferred embodiments of the present invention will now be described.

Referring to FIGS. 1 to 8, an embodiment of a packaging material according to the present invention will now be described.

Figure 1:
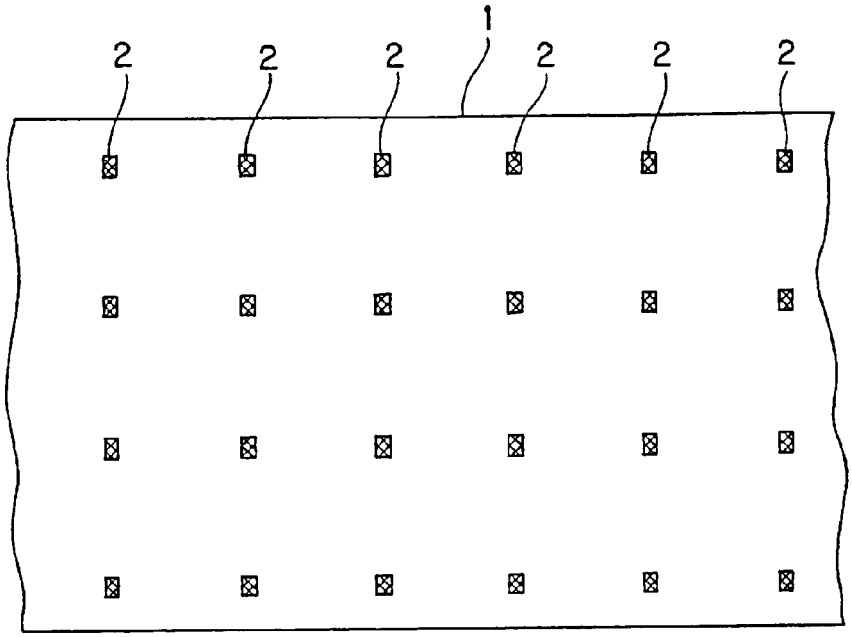
FIG. 1 is a plan view showing a packing material according to one embodiment of the present invention.

As shown in FIG. 1, a packaging material 1, which provides one original material for producing a packaging bag 20 or others, is incorporated into a bag product that requires relatively weaker and stronger sealing portions region by region.

A coating agent is applied to the packaging material 1 at intervals. The coating agent has the function of preventing two packaging materials 1 from being sealed to each other and is applied to predetermined locations 2 at which weaker sealing portions are formed (hereafter, such locations are referred as "weaker sealing portion formers"). Incidentally, in the case of the packaging material 1 shown in FIG. 1, the coating agent is applied to form the weaker sealing portion formers 2 spot by spot, but this is not a definite list. Depending on products to be manufactured, stronger sealing portions may be formed spot by spot, in which the coating agent is applied so that the weaker sealing portion former may be established on the remaining most part of the packaging material 1.

Figure 2:
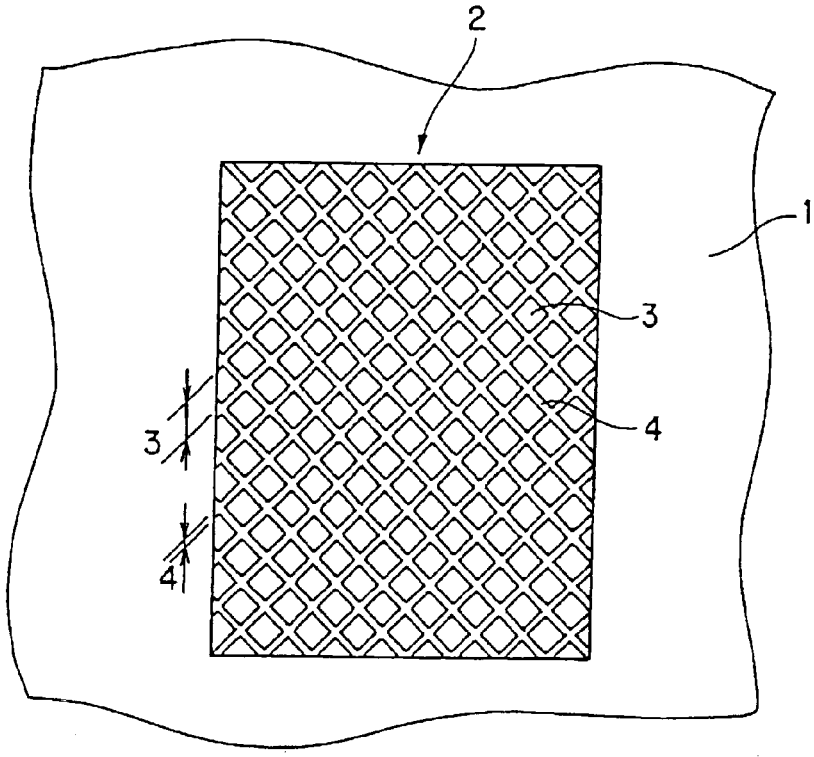
FIG. 2 is an enlarged view of a weaker sealing portion former arranged on the packing material shown in FIG. 1.

FIG. 2 shows an enlarged display of one of the weaker sealing portion formers 2. In each weaker sealing portion former 2, the coating agent is applied to a specified ratio of areas on the packaging material 1, thus forming a plurality of tiny rectangular agent applied regions 3. A plurality of agent non-applied regions 4 are formed between the agent applied regions 3, like a mesh form, in which the coating agent is not applied to the packaging material 1.

Controlling a ratio of areas between the agent applied regions 3 and the agent non-applied regions 4 in each weaker sealing portion former 2 gives it easily a desired sealing intensity. Practically, to make the sealing intensity higher, a ratio of the area occupied by the agent non-applied regions 4 is made greater so as to provide a larger area to which another packaging material is heat-sealed. On the other hand, to make the sealing intensity lower, a ratio of the area occupied by the agent non-applied regions 4 is made smaller so as to provide a larger area that is not subject to the heat sealing process.

The coating agent to form the weaker sealing portion formers 2 is made of resin whose heat resistance is high enough not to melt when two packaging materials 1 are mutually heat-sealed. It is preferred that such coating agent is made of silicon resin or shellac categorized into natural resin. This coating agent is applied to the packaging material 1 through printing processes. For printing silicone resin, liquid silicone resin is produced, and it is applied to the material 1 with use of a gravure technique. The printed portions are then subject to a drying process at an ambiance of 120 to 130° C. for fixation. When printing the shellac, the shellac is first dissolved in ethanol, and then the dissolved shellac is subject to gravure processes. After drying, the printing portions are dried at an ambiance of 100° C. for fixation on the packaging material 1.

As understood from the above, in drying the printed coating-agent portions, the temperature should be raised up to 120 to 130° C. in cases where the silicone resin is employed as the coating agent. Meanwhile, if the shellac is employed, it is enough that the temperature is raised only up to 100° C., which is lower than that for the silicon resin. Therefore, the shellac is advantageous in that its lower drying temperature makes it possible to broaden user's choices of types of the packaging material 1 itself.

The shellac, which is a product made from secretions of lac insects making their habitats in Assam in India and Bilma, contains not more than 95% wt of resin, 1.5 to 5% wt of wax, traces of protein, traces of saccharides, and others. The resin component is a compound of resin acid, such as aleuritic acid ($C_{16}H_{32}O_5$), shellolic acid ($C_{15}H_{20}O_6$), and butolic acid ($C_{14}H_{28}O_8$). The shellac is an environment-friendly raw material, which does not contain harmful organic constituents at all. Hence, one of preferable examples is that medical appliances made to touch the human body use the packaging bag 20.

Figure 3:
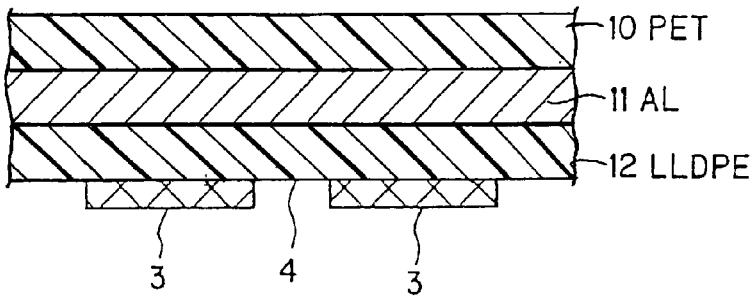
FIG. 3 shows a layered structure of the packaging material.

Meanwhile, as shown in FIG. 3, the packaging material 1 is formed into a structure of layered films, of which layered construction is made up of, from outside of the packaging bag 20, by turns, a polyethylene terephthalate layer (PET) 10, an aluminum foil layer (AL) 11, and a liner low density polyethylene film layer (LLDPE) 12. Each layer is made to adhere to another layer with the help of an adhesive. This packaging material 1 has the aluminum foil layer 11 as an intermediate layer, resulting in that the material 1 is able to have both of high light blocking effect and high barrier effect toward shocks or others. However, if those effects do not have higher technical priority, the aluminum foil layer 11 may be removed from the layers of the packaging material 1.

Referring to FIGS. 4 to 8, the packaging bag 20 made of the packaging material 1 described above.

Figure 4:
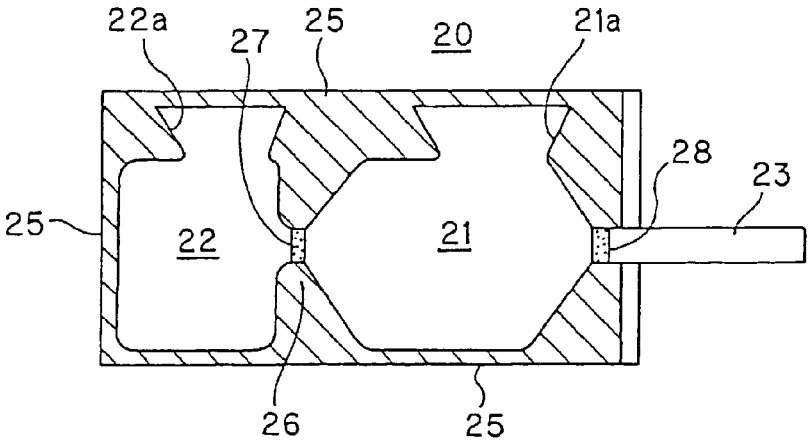
FIG. 4 explains one mode of a packaging bag formed by the use of the packing material shown in FIG. 1.

Such packaging bag 20 is exemplified in FIG. 4. This packaging bag 20 is used to mix two types of artificial bone medicament with each other within the bag 20 and to inject the mixed medicaments into the human body. The exterior appearance of the bag 20 is formed into a rectangular and a tube 23 for injecting the mixed medicaments is extended outward from one end thereof.

This packaging bag 20 is produced by mutually laminating and bonding two packaging materials, face to face, in which two closed containing spaces 21 and 22 are partitioned to align in the longitudinal direction of the bag 20. The base end of the tube 23 inserted into a rim portion of one side of the top-sided containing space 21 and is able to have communication with the inside of the containing space 21.

The two different types of mendicants are contained in the two containing spaces 21 and 22, respectively. The medicaments contained separately within the spaces 21 and 22 are mixed with each other when necessary, and from the top-sided containing space 21, the mixed medicaments are discharged through the tube 23.

The packaging materials 1 are produced into a bag form, that is, the packaging bag 20, by mutually heat-sealing their rim portions 25 firmly so as not to allow their rim portions 25 to open. A partition 26 is placed between the containing spaces 21 and 22 and heat-sealed so as not to open as well. Both of part of the partition 26 and a connecting part between the top-sided container space 21 and the duct 23 are formed into weaker sealed portions 27 and 28, each of which shielding strength is weaker than the remaining heat-sealed portion (refer to a shaded portion in FIG. 4). The weaker sealed portions 27 and 28 correspond to a first sealed portion of the present invention.

This remaining heat-sealed portion, which includes the rim portions 25 of the packaging materials 1 and the partition 26 between the containing spaces 21 and 22, constitutes a stronger sealed portion. This stronger sealed portion (25 and 26) corresponds to a second sealed portion of the present invention. The weaker sealed portions 27 and 28 are composed by the aid of the weaker sealing portion formers 2 formed on the foregoing packaging material 1 (refer to FIG. 1).

When medicaments contained in the two containing spaces 21 and 22 are mixed with each other, the weaker sealed portion 27 is broken to be unsealed responsively to pressure given by hand. That is, the weaker sealed portion 27 is separated between the weakly heat-sealed materials 1. Hence both of the containing spaces 21 and 22 are communicated to each other, and the medicaments are mixed with other by moving into the mutual spaces 21 and 22.

This is true of the other weaker sealed portion 28 disposed at the root portion of the duct 23. When the mixed medicaments are discharged from the containing bag 20, the weaker sealed portion 28 is separated (peeled off) between the weakly heat-sealed materials 1, responsively to pressure given by hand. This allows the duct to communicate with the top-sided containing space 21.

Figure 5:
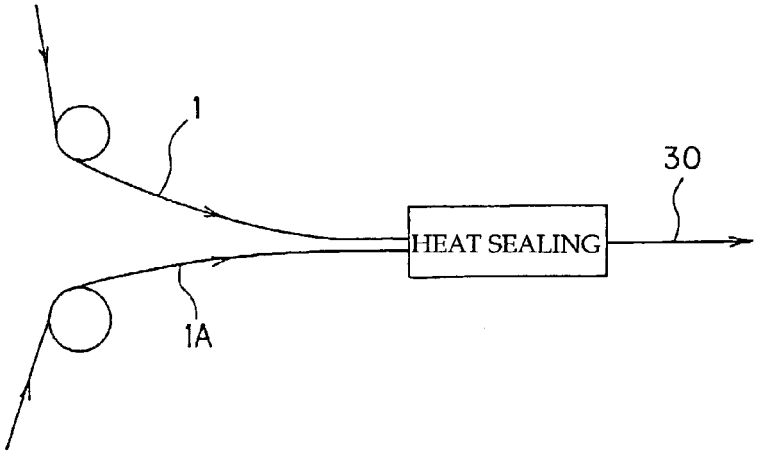
FIG. 5 explains a heat sealing process adopted to produce the packaging bag.

The packaging bag 20 is formed by heat sealing two packaging materials 1 and 1A to be arranged face to face, as shown in FIG. 5. On one of the materials 1 and 1A, that is, on the packaging material 1, the foregoing weaker sealing portion formers 2 are formed, to which a certain coating agent is applied at given intervals (refer to FIG. 1). The other packaging material 1A is made as an ordinary packaging material with no such weaker sealing portion formers 2 thereon.

Figure 6A:
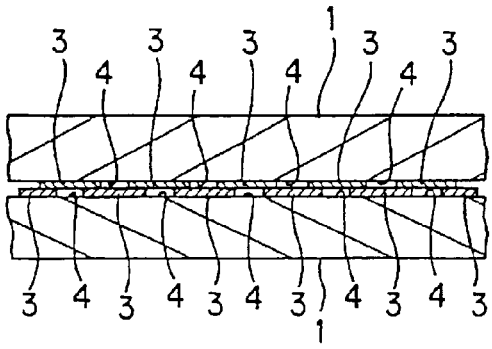
FIGS. 6A and 6B show sections each explaining an enlarged weaker sealing portion.

If both of the packaging materials 1 and 1A are produced with such weaker sealing portion formers 2 thereon, there is a possibility that the weaker sealing portion formers 2 on both the materials are made to overlap one on the other. In this case, as shown in FIG. 6A, overlapping of between the agent applied portions 3 on one-side material and the agent non-applied portions 4 on the other-side material is highly probable. Such an overlapping configuration prevents both the materials 1 and 1A from being sealed with each other when heated, thus no weaker sealed portions being obtained.

Figure 6B:
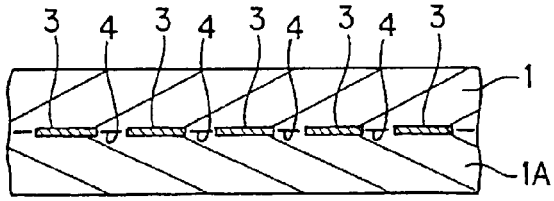

As can be seen in the present embodiment, giving the weaker sealing portion formers 2 to only one material solves such a problem. In other words, employing both of one packaging material 1 with the weaker sealing portion formers 2 (with the coating agent) and the other packaging material 1A with no weaker sealing portion formers 2 surely avoids the overlapping phenomenon thereof. This is illustrated in FIG. 6B, in which the agent non-applied portions 4 formed on one packaging material 1 is allowed to be melted with the other packaging material 1A, thus forming the weaker sealed portions 27 and 28.

However, as long as the feed of both the packaging materials 1 and 1A is exactly controlled so that both of the weaker sealing portion formers 2 are not overlapped one on the other, such formers 2 may be formed on both the materials 1 and 1A.

Figure 7:
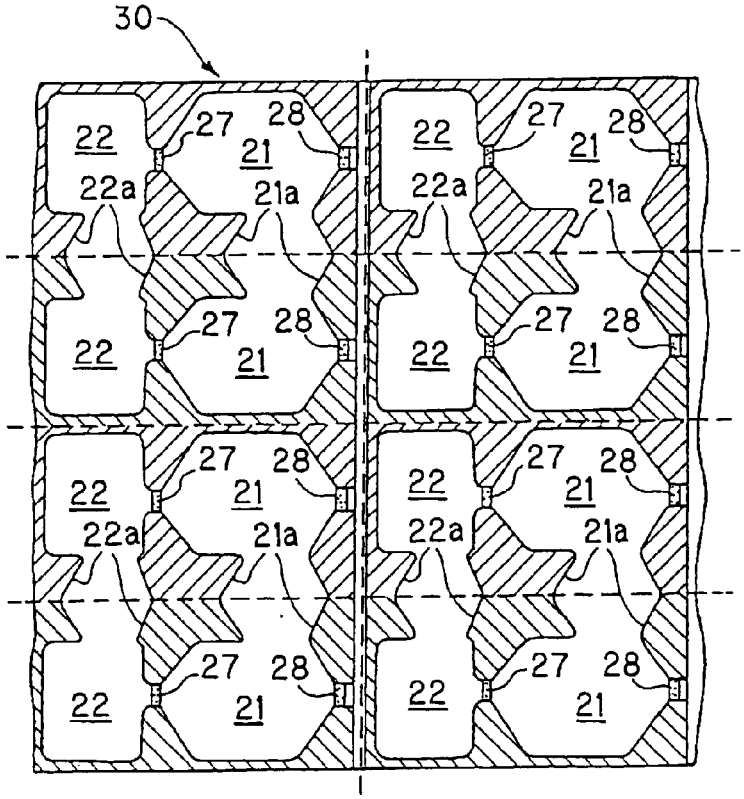
FIG. 7 shows half finished products each used for manufacturing the packing bag shown in FIG. 4.

The above two packaging materials 1 and 1A are subjected to a heat sealing process, and manufactured into a strip-shaped half-finished product composed of a plurality of packaging bags 20 still continuously connected (refer to FIG. 7). The heat sealing is carried out such that two-position weaker sealing portion formers 2 separately produced on one packaging material 1 are located precisely at the positions of the partition 26 between the containing spaces 21 and 22 and the root portion of the duct 23, respectively. Partial edge portions 21*a* and 22*a* at which medicament injection ports are formed have not still heat-sealed.

After the heat sealing process, the half-finished product is cut into pieces at its predetermined positions shown by broken lines in FIG. 7, thus providing individual packaging bas 20, though the bags are still half-finished. Then, for each half-finished bag, the duct 23 is inserted into the one-side rim portion of the top-sided containing portion 21 so as to reach the weaker sealed portion 28 arranged therein. Different types of medicaments are then injected into the containing spaces 21 and 22 of each bag through its medicament injection ports, respectively. After completion of such injections, the rim portions 25 (the partial edge portions 21*a* and 22*a*) at the injection ports are heat-sealed, thereby completing each packaging bag.

Figure 8A:
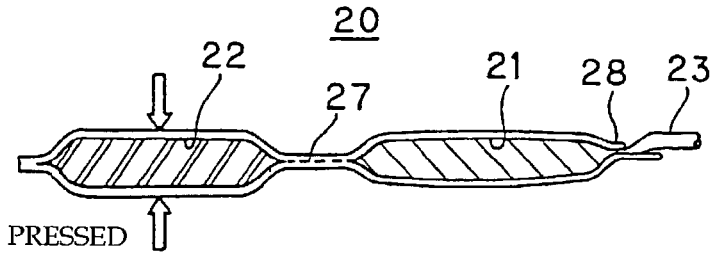
FIGS. 8A to 8D explain a series of steps in which different types of medicaments contained in different containing spaces partitioned within the same packaging bag are mixed with each other in response to separating the packaging materials at their weaker sealed portions.
Figure 8B:
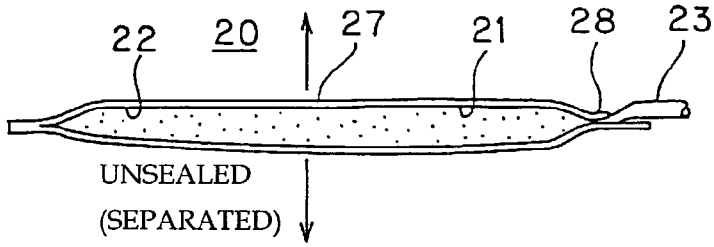
Figure 8C:
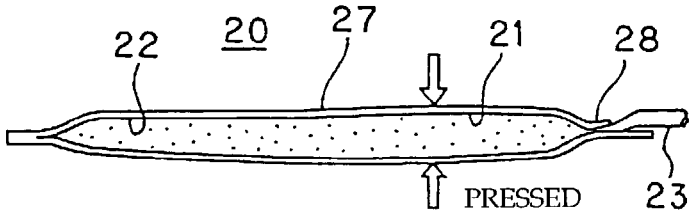
Figure 8D:
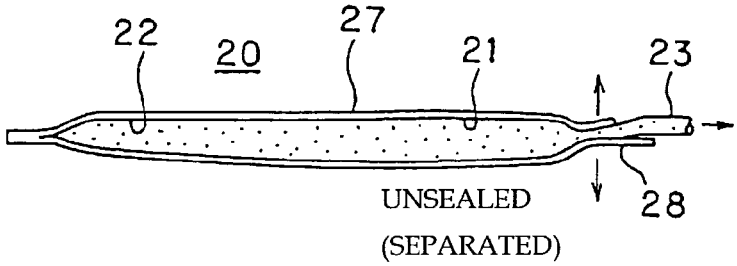

Each packaging bag 20, which is manufactured as described above, is used as follows. As shown in FIGS. 8A and 8D, differently types of medicaments are mutually mixed, and then the mixed medicaments are discharged through the duct 23.

Practically, for mixing the medicaments, as shown in FIG. 8A, the tail-sided containing space 22 with no connection to the duct 23 is pressed by hand. This pressing operation will cause both the packaging materials 1 and 1A to separate at the weaker sealing portion 27 (i.e., one material will peeled off from the other material). This separation, which can be illustrated as in FIG. 8B, allows the two containing spaces 21 and 22 to mutually communicate through the weaker sealing portion 27, thus allowing the two types of medicaments to be mixed with each other within the bag 20.

The mixed medicaments are discharged from the packaging bag 20 at a proper time, such as, being necessary to inject them into the human body. In this case, as illustrated in FIG. 8C, the containing spaces 21 and 22 that haven already been communicated with each other are pressed by hand. This pressing operation will increase the inner pressure in the containing spaces 21 and 22, which will then cause the packaging materials 1 and 1A to separate from each other at the other weaker sealed portion 28 to which the duct 23 is connected (refer to FIG. 8D). This separation permits the duct to comminute with the top-sided containing space 21, that is, both the spaces 21 and 22. Hence the mixed medicaments can be discharged from the bag 20 through the duct 23.

As described above, the packaging bag 20 in which the weaker sealed portions 27 and 28 are formed partially has been described, but an area ratio between the weaker and stronger sealed portions is not limited to the above explanation. For example, most of the heat-sealed portion (area) can be made into a weaker sealed portion having a relatively weaker sealing strength, while only the remaining small portion can be assigned to a stronger sealed portion.

Experiments

Table 1 shows the comparison of sealing strength between weaker and stronger sealed portions. In this experiment, test pieces were used each of which has a weaker sealed portion of which agent applied portion is 95 percents of the entire area thereof. The sealing strength was tested on each sample heat-sealed at a sealing pressure of 2 kg/cm$^2$ for a sealing time of 1 second at temperatures at 160, 170, 180, and 200° C., respectively. In table 1, values of load required for peeling off the sealed portions each having a length of 15 mm are listed.

TABLE 1

| | Sealing temperature | Sealing strength (kg/15 mm) | |
|---|---|---|---|
| | (° C.) | data | average |
| Occupied rate of area of coating agent applied region 95% weakly sealed | 160 | 0.30 to 0.37 | 0.34 |
| | 170 | 0.38 to 0.45 | 0.41 |
| | 180 | 0.46 to 0.50 | 0.49 |
| | 200 | 0.52 to 0.60 | 0.55 |
| Without application of coating agent strongly sealed | 160 | 4.7 to 4.9 | 4.8 |
| | 170 | 4.7 to 5.0 | 4.9 |
| | 180 | 4.9 to 5.1 | 5.0 |
| | 200 | 4.8 to 5.1 | 5.0 |

As understood from table 1, in cases where the weaker sealed portions are formed such that the agent applied portion occupies each weaker sealed portion by 95 presents, the sealing strength of the weaker sealed portions showed, to that of a conventional ordinary heat sealed portion, approximately 7 percents at 160° C., 8.5 percents at 170° C., 9.8 percents at 180° C., and 11 percents at 200° C. A conclusion can be obtained that the weaker sealed portion according to the present invention is able to lessen the sealing strength in a steadier and easier manner.

Additionally, Table 2 shows the comparison of sealing strength among sealed portions of which agent applied and agent non-applied portions are mutually changed in their area ratios. In this experiment, test pieces were used each of which has a weaker sealed portion of which agent applied portion is 80, 90 and 95 percents, respectively, of the entire area thereof. The sealing strength was tested on each sample heat-sealed at a sealing pressure of 2 kg/cm$^2$ for a sealing time of 1 second at temperatures of 160, 170, 180, and 200° C., respectively. In table 2, values of load required for peeling off the sealed portions each having a length of 15 mm are listed.

TABLE 2

| Occupied rate of area of coating agent applied region | Sealing strength (kg/15 mm) Sealed at 160° C. | Sealed at 180° C. | Sealed at 200° C. |
|---|---|---|---|
| 0% | 4.8 (4.7 to 4.9) | 5.0 (4.9 to 5.1) | 5.0 (4.8 to 5.1) |
| 80% | 1.22 (0.92 to 1.30) | 1.17 (1.01 to 1.28) | 1.17 (1.10 to 1.30) |
| 85% | 0.66 (0.50 to 0.72) | 0.66 (0.55 to 0.76) | 0.68 (0.59 to 0.80) |
| 90% | 0.34 (0.30 to 0.37) | 0.49 (0.46 to 0.50) | 0.55 (0.52 to 0.60) |

The Table 2 shows clearly that, despite the heat sealing temperatures, the larger the area ratio of the agent applied portion, the smaller the force required for separating the materials at the weaker sealed portions.

Accordingly, when reducing the present invention into practice toward the packaging bag 20 with the two containing spaces 21 and 22 shown in FIG. 4, the above tests revealed a greatly preferable configuration of the bag 20. That is, it is best preferable that the weaker sealed portion is occupied by 95 percent of the agent applied portion and the sealing strength is set to a range of about 0.2 to 0.6 kg/15 mm.

The present invention may be embodied in other specific forms without departing from the spirit or essential characteristics thereof. The present embodiments are therefore to be considered in all respects as illustrative and not restrictive, the scope of the present invention being indicated by the appended claims rather than by the foregoing description and all changes which come within the meaning and range of equivalency of the claims are therefore intended to be embraced therein.

The entire disclosure of each of Japanese Patent Application No. 2001-238361 filed on Aug. 6, 2001 including the specification, claims, drawings and summary is incorporated herein by reference in its entirety.

What is claimed is:

1. A packaging bag comprising:

a bag body formed by bonding a first packaging material film and a second packaging material film to provide an inner hollow portion including a plurality of spaces in which different substances to be mixed together are accommodated; and a duct having one end for communicating with one of the plurality of spaces formed in the inner hollow portion of the bag body and another end for extending outward of the bag body, wherein (1) at least one of the said first and second packaging material films includes a weak seal portion and a strong seal portion having a sealing strength stronger than the sealing strength of the weak seal portion, (2) the first and second packaging films are heat-sealed to each other to form a plurality of spaces surrounded by the strong seal portion such that adjacent spaces are connected through the weak seal portion for easy communication with each other, (3) the duct having one end inserted into the bag body, the end being closed by a second weak seal portion, the closed end being opened when pressure is applied to the second weak seal portion, to break the second weak seal portion establishing communication between the one of the plurality of spaces and the duct through the second weak seal portion, and (4) said weak seal portion comprise a printed area of a coating agent provided with an applied area of a coating agent that serves to prevent heat sealing, and a non-applied area of the coating agent, said coating agent applied area and non-applied area being arranged in a predetermined pattern with an applied area ratio of 80 to 90% determined to provide a sealing strength required for the weak seal portions.

2. The packaging bag according to claim 1, wherein the coating agent is a heat-resistant resin.

3. The packaging bag according to claim 2, wherin the coating agent is shellac.

4. The packaging bag according to claim 1, wherin the packaging material film is a film having a layers structure including an aluminum foil layer.

* * * * *